United States Patent [19]

South

[11] Patent Number: 4,768,620

[45] Date of Patent: Sep. 6, 1988

[54] METAL EXTENSION PLANKS

[75] Inventor: Robert E. South, Warsaw, Ind.

[73] Assignee: White Metal Rolling & Stamping Corp., Smithtown, N.Y.

[21] Appl. No.: 97,093

[22] Filed: Sep. 16, 1987

[51] Int. Cl.[4] ..... E04G 5/08; A47B 1/10

[52] U.S. Cl. ..... 182/223; 52/632; 108/65

[58] Field of Search ..... 182/223, 118, 131; 52/632; 108/65

[56] References Cited

U.S. PATENT DOCUMENTS

| | | | |
|---|---|---|---|
| 812,301 | 2/1906 | Schwedt | 108/65 |
| 1,774,268 | 8/1930 | Harding | 182/223 |
| 2,120,158 | 6/1938 | Starrick | 108/65 |

FOREIGN PATENT DOCUMENTS

| | | | |
|---|---|---|---|
| 338958 | 7/1959 | Switzerland | 182/223 |

*Primary Examiner*—James L. Ridgill, Jr.

*Attorney, Agent, or Firm*—Carroll F. Palmer

[57] ABSTRACT

An extension plank has first and second elongated sections that telescope from a plank maximum length to a minimum length. Such sections have an outboard portion and an inboard portion joined by a plurality of parallel tubular elements of rectangular cross-section. The outboard portion includes an elongated U-shaped channel and the outboard ends of the tubular elements are fixed into the U-shaped channel spaced apart from each other. The inboard portion includes a pair of straps and a plurality of U-shaped guide saddles. The straps are fastened to each of the tubular members with a guide saddle sandwiched therebetween. The inboard portion of the first elongated section slideably encloses the tubular elements of the second elongated section and the inboard portion of the second elongated section slideably encloses the tubular elements of the first elongated section whereby the elongated sections can telescope with each other and the guide saddles provide free, easy sliding action between the elongated sections.

12 Claims, 1 Drawing Sheet

METAL EXTENSION PLANKS

BACKGROUND OF THE INVENTION

1. Field of the Invention

This invention relates to adjustable length planks that may be extended across trestles or the like to provide elevated support platforms.

2. Description of the Prior Art

Scaffolds and other forms of elevated platforms, usually of a temporary nature, are extensively used by workmen to provide support for performing work on elevated structures. Typically, such platforms include planks that extend between trestles or other vertical support members. Historically, wooden boards have served as such planks, but this practice has been greatly diminished because of federal and state occupational safety regulations. Thus, metal planks have extensively replaced the use of wood planks.

While use of metal can provide stronger, safer planks than wood, weight then becomes a problem so planks made of metal must be designed to provide maximum support strength with minimum weight. Also, in view of cost considerations, metal planks can not be discarded on site at the completion of a work project, as often was done with wood planks, so planks made of metal must be designed to assist in their transportation from one site to another, e.g., made adjustable in length for ease of shipping.

OBJECTS

A principal object of the invention is the provision of improved forms of metal extension planks.

Further objects include the provision of:

1. Extension planks having a tubular construction so arranged that twisting thereof is strongly resisted.
2. Such planks that meet OSHA and ANSI code A10.8 requirements.
3. Improved metal extension planks that provide free and easy sliding action between sections.
4. Such planks having means to eliminate pinching between sections and to control maximum extended length.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of extension planks comprising first and second elongated sections that telescope between a plank maximum length and a minimum length. Each elongated section comprises as outboard portion, an inboard portion and a plurality of parallel tubular elements that extend therebetween. The tubular elements are all of rectangular cross-section, preferably all of substantially the same size and are defined by a pair of short sides and a pair of long sides.

The outboard portion of each of its two sections comprises an elongated U-shaped channel defined by a base section and a pair of side sections. The outboard ends of the tubular elements are fixed into the U-shaped channel spaced apart from each other a distance greater than the width of the short sides and with the long sides spanning the space between the channel side sections.

The inboard portion of each section comprises first and second straps having in-turned ends and a plurality of guide saddles equal in number to the number of the tubular elements. Such guide saddles are U-shaped, preferably made of plastic, e.g., nylon, and are defined by a base web and a pair of short side webs with the side webs being spaced apart a distance substantially equal to the width of the short sides of the tubular elements.

In each section, the first strap is fastened to each of the tubular members in the section with one of the guide saddles sandwiched between a short side thereof and the first strap so the saddle side webs project away from the first strap. The second strap is fastened in the manner of the first strap to the other short side of the tubular members.

In the plank, the inboard portion of the first elongated section slideably encloses the tubular elements of the second elongated section and the inboard portion of the second elongated section slideably encloses the tubular elements of the first elongated section whereby the elongated sections can telescope with each other and the guide saddles provide free, easy sliding action between the elongated sections.

In preferred embodiments of the new planks, their parts, except for the guide saddles, are made of metal, the tubular elements are fixed to the U-shaped channel and the straps by rivets and each of the elongated sections contains an odd number of the tubular elements and, specifically, five which have their short sides longitudinally serrated. Further, the short sides of the middle tubular element of each section have stop members fixed thereto, i.e., each short side of the middle tubular element has a first stop member fixed thereto juxtaposed to the U-shaped channel which controls the minimum length and a second stop member fixed a substantial distance from the first stop member which controls the maximum length.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
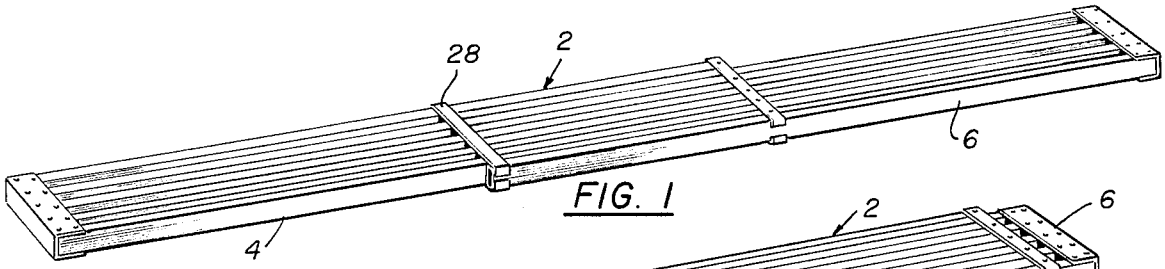
FIG. 1 is an isometric view of a new extension plank of the invention fully extended.
Figure 2:
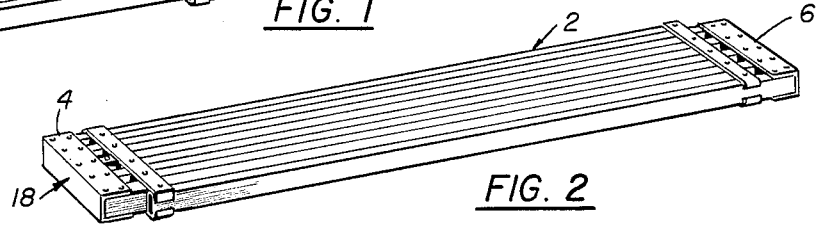
FIG. 2 is an isometric view of the new extension plank fully telescoped.
Figure 3:
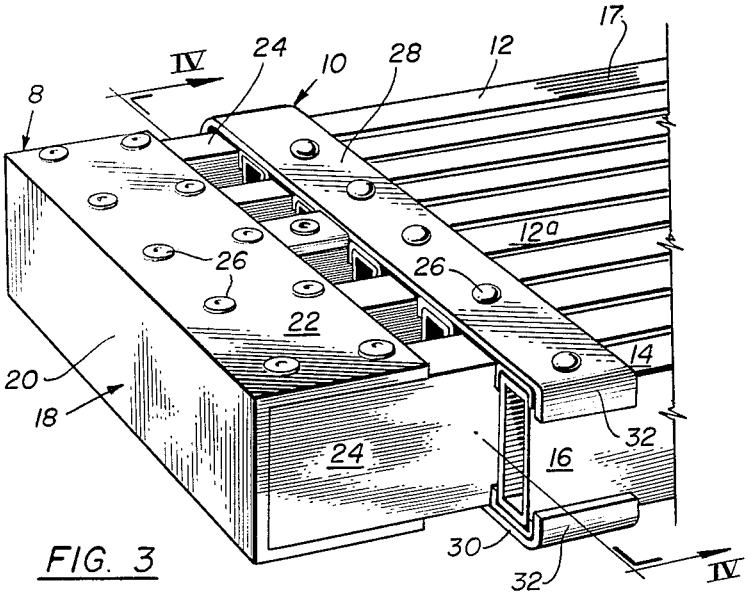
FIG. 3 is an enlarged, fragmentary view of the left end of the plank as seen in FIG. 2.
Figure 5:
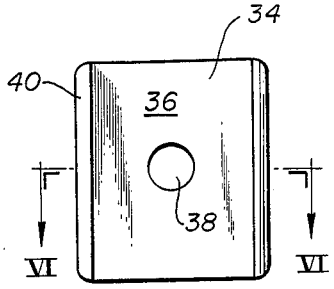
FIG. 5 is a plan view of a guide saddle for the new planks.
Figure 6:
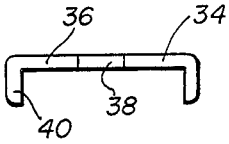
FIG. 6 is a sectional view taken on the line VI—VI of FIG. 5.

Referring in detail to the drawings, in which identical parts are identically marked, an extension plank 2 of the invention comprises first and second elongated sections 4 & 6 that telescope from a plank maximum length (FIG. 1) to a minimum length (FIG. 2).

Each elongated section 4 or 6 comprises an outboard portion 8, an inboard portion 10 and a plurality of parallel tubular elements 12. The tubular elements 12 all are of rectangular cross-section defined by a pair of short sides 14 and a pair of long sides 16.

The short sides of the tubular elements have longitudinal serrations 17.

The outboard portion 8 comprises an elongated U-shaped channel 18 defined by a base section 20 and a pair of side sections 22. The outboard ends 24 of the tubular elements 12 are fixed by rivets 26 into the U-shaped channel 18 spaced apart from each other a distance greater than the width of the short sides 14 and with the long sides 16 spanning the space between the channel side sections 22.

The inboard portion 10 comprises first and second straps 28 & 30 have in-turned ends 32 plus a plurality of guide saddles 34 equal in number to the number of the tubular elements 12. The guide saddles 34 are U-shaped defined by a base web 36 bearing a central hole 38 and a pair of short side webs 40 which are spaced apart a distance substantially equal to the width of the short sides 14.

The first strap 28 is fastened by rivets 26 to each of the tubular members 12 with one of the guide saddles 34 sandwiched between a short side 14 thereof and the first strap 28 so the side webs 40 project away from the first strap 28.

The second strap 30 is fastened in the manner of the first strap to the other short side 14 of the tubular members 12.

The inboard portion 10 of the first elongated section 4 slideably encloses the tubular elements 12 of the second elongated section 6 and the inboard portion 10 of the second elongated section 6 slideably encloses the tubular elements 12 of the first elongated section 4 whereby the elongated sections 4 & 6 can telescope with each other.

Figure 4:
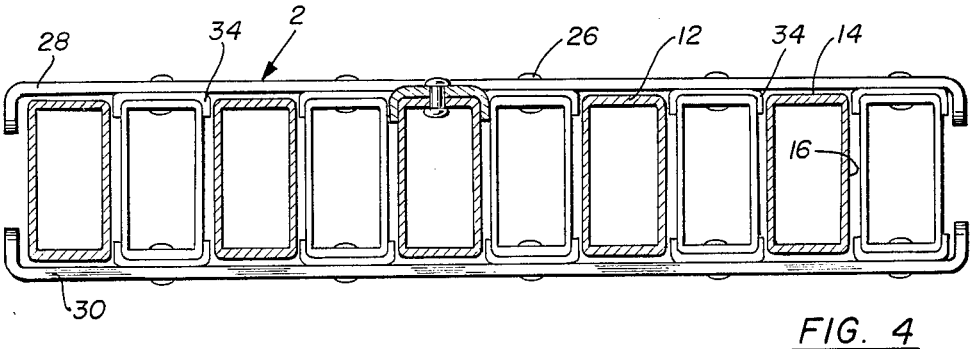
FIG. 4 is a sectional view taken on the line IV—IV of FIG. 3.
Figure 7:
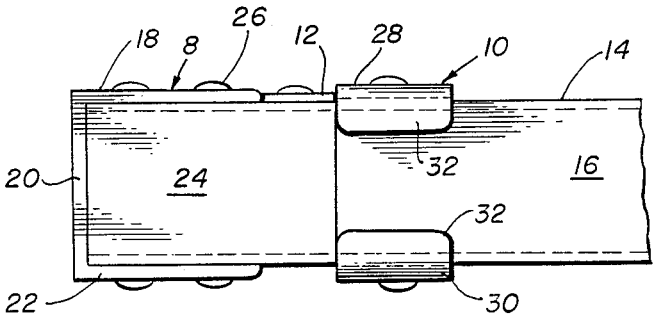
FIG. 7 is a fragmentary, lateral view corresponding to the isometric view of FIG. 3.

The guide saddles 34 provide free, easy sliding action between the elongated sections 4 & 6 (see FIG. 4).

The middle tubular element 12*a* of each section 4 & 6 has a first stop member 42 fixed thereto by a rivet 26 juxtaposed to the U-shaped channel 18 which controls the minimum length. Also, there is a second stop member 44 fixed a substantial distance from the first stop member which controls the maximum length.

The embodiments of the invention in which an exclusive property or privilege is claimed are defined as follows:

1. An extension plank comprising first and second elongated sections that telescope from a plank maximum length to a plank minimum length, each said elongated section comprising:

an outboard portion, an inboard portion and a plurality of parallel tubular elements that extend therebetween, said tubular elements all being of rectangular cross-section defined by a pair of short sides and a pair of long sides, said outboard portion comprising an elongated U-shaped channel defined by a base section and a pair of side sections, the outboard ends of said tubular elements being fixed into said U-shaped channel spaced apart from each other a distance greater than the width of said short sides and with said long sides spanning the space between said channel side sections, said inboard portion comprising first and second straps having in-turned ends and a plurality of guide saddles, said guide saddles being U-shaped defined by a base web and a pair of short side webs, said side webs being spaced apart a distance substantially equal to the width of said short sides, said first strap being fastened to each of said tubular elements with one of said guide saddles sandwiched between a short side thereof and said first strap so said side webs project away from said first strap, and said second strap being fastened in the manner of said first strap to the other short side of said tubular elements, said inboard portion of said first elongated section slideably enclosing said tubular elements of said second elongated section and said inboard portion of said second elongated section slideably enclosing said tubular elements of said first elongated section whereby said elongated sections can telescope with each other and said guide saddles provide free, easy sliding action between said elongated sections.

2. The extension plank of claim 1 in which its parts, except for said guide saddles, are made of metal.

3. The extension plank of claim 1 wherein said tubular elements are fixed to said U-shaped channel by rivets.

4. The extension plank of claim 1 wherein said tubular elements are fixed to said first and second straps by rivets.

5. The extension plank of claim 1 wherein said short sides of said tubular elements are serrated longitudinally.

6. The extension plank of claim 1 wherein said tubular elements are all of substantially the same cross-sectional size.

7. The extension plank of claim 1 wherein said guide saddles are made of plastic.

8. The extension plank of claim 7 wherein said plastic is nylon.

9. The extension plank of claim 1 wherein each of said elongated sections contains an odd number of said tubular elements.

10. The extension plank of claim 9 wherein said odd number is five.

11. The extension plank of claim 10 wherein said short sides of the middle tubular element of said five have stop members fixed thereto.

12. The extension plank of claim 11 wherein each said short side of the middle tubular element of said five has a first stop member fixed thereto juxtaposed to said U-shaped channel which controls said minimum length and a second stop member fixed a substantial distance from said first stop member which controls said maximum length.

* * * * *